US008632272B2

(12) United States Patent
Wojtowicz et al.

(10) Patent No.: US 8,632,272 B2
(45) Date of Patent: Jan. 21, 2014

(54) OUTSIDE WRAP POST COUPLER ACCOMMODATING BEAM RIVET

(75) Inventors: David J. Wojtowicz, Orland Park, IL (US); Thomas St. Germain, Bridgeview, IL (US); Mitchell Liss, Northbrook, IL (US); Al Dunaj, Chicago, IL (US)

(73) Assignee: Edsal Manufacturing Co., Inc., Chicago, IL (US)

( * ) Notice: Subject to any disclaimer, the term of this patent is extended or adjusted under 35 U.S.C. 154(b) by 109 days.

(21) Appl. No.: 13/184,506

(22) Filed: Jul. 16, 2011

(65) Prior Publication Data

US 2011/0272541 A1 Nov. 10, 2011

Related U.S. Application Data

(63) Continuation-in-part of application No. 11/044,689, filed on Jan. 27, 2005.

(51) Int. Cl.
*A47B 57/06* (2006.01)

(52) U.S. Cl.
USPC ..... 403/300; 403/176; 312/265.4; 211/182

(58) Field of Classification Search
USPC ..... 312/265.1, 265.4; 211/182, 189, 190, 211/191, 192, 194; 403/169, 171, 176, 231, 403/241, 286, 300, 403
See application file for complete search history.

(56) References Cited

U.S. PATENT DOCUMENTS

| | | | | | |
|---|---|---|---|---|---|
| 1,970,422 | A * | 8/1934 | Foster | ..... | 403/300 |
| 2,226,763 | A * | 12/1940 | Geib et al. | ..... | 211/194 |
| 3,056,507 | A * | 10/1962 | Squires, Jr. et al. | ..... | 108/106 |
| 3,481,486 | A * | 12/1969 | Squires | ..... | 211/153 |
| 4,545,490 | A * | 10/1985 | Hsiao et al. | ..... | 211/182 |
| 4,582,001 | A * | 4/1986 | Leikarts | ..... | 211/187 |
| 5,553,549 | A * | 9/1996 | Nilsson | ..... | 108/110 |
| 7,510,345 | B2 * | 3/2009 | Kosh et al. | ..... | 403/330 |
| 2011/0272542 | A1 * | 11/2011 | Wojtowicz et al. | ..... | 211/134 |

* cited by examiner

*Primary Examiner* — Michael P Ferguson
(74) *Attorney, Agent, or Firm* — Wood, Herron & Evans, LLP

(57) ABSTRACT

A post coupler is provided with a pair of coupler flanges having rivet receiving apertures for receiving rivets extending from horizontal shelf-supporting beams to facilitate vertical shelf placement in a shelving unit unfettered by the vertical disposition of the post couplers. Apertures in the coupler index with apertures in abutting corner post sections to permit rivet extension therethrough. The reverse bend flanges of the coupler have a length shorter than the overall length of the coupler.

12 Claims, 14 Drawing Sheets

OUTSIDE WRAP POST COUPLER ACCOMMODATING BEAM RIVET

PRIORITY CLAIM

This application is a Continuation-in-Part of U.S. patent application Ser. No. 11/044,689 filed Jan. 27, 2005, published under Publication No. US2006/0163438, entitled "POST COUPLER", both of which are expressly incorporated herein by reference in their entirety.

RELATED PATENT APPLICATIONS

This application is related to co-pending applications filed on even date herewith and including:

U.S. application Ser. No. 29/397,486 entitled "DESIGN FOR WRAPPED POST COUPLER";

U.S. application Ser. No. 29/397,490 entitled "DESIGN FOR POST COUPLER WITH SCALLOPED EDGES";

U.S. application Ser. No. 29/397,488 entitled "DESIGN FOR POST COUPLER WITH KEYHOLE OPENING";

U.S. application Ser. No. 13/184,509 entitled "OUTSIDE WRAP POST COUPLER WITH ASSEMBLY ASSIST";

U.S. application Ser. No. 29/397,487 entitled "DESIGN FOR POST COUPLER WITH INSIDE WRAP";

U.S. application Ser. No. 29/397,485 entitled "DESIGN FOR POST COUPLER WITH SCALLOPED EDGES AND INSIDE WRAP";

U.S. application Ser. No. 29/397,489 entitled "DESIGN FOR POST COUPLER WITH KEYHOLES AND INSIDE WRAP";

U.S. application Ser. No. 13/184,507 entitled "INSIDE WRAP POST COUPLER ACCOMMODATING BEAM RIVET";

U.S. application Ser. No. 13/184,511 entitled "INSIDE WRAP POST COUPLER WITH ASSEMBLY ASSIST"; and U.S. application Ser. No. 29/397,491 entitled "DESIGN FOR INNER POST COUPLER".

All these related applications are herewith expressly incorporated herein by reference as if fully set out herein.

FIELD OF THE INVENTION

This invention relates to shelving and post couplers used in coupling shelf supporting columns end-to-end and accommodating horizontal shelf-supporting beams.

BACKGROUND OF THE INVENTION

Prior post couplers have been used to couple post ends together to form an elongated, unitary corner post or column used with other corner posts to support a plurality of shelves mounted on elongated brackets or beams connected to and extending horizontally between the corner posts. Typically, the posts are of angled construction defined by flanges at 90° to each other and are provided with keyhole-shaped slots for receiving rivets extending from the elongated shelf beams which are oriented horizontally between the posts. The rivets interlock the beams to the posts to define a ladder-like shelf frame on which shelves are supported.

These beams can thus be adjusted vertically, up and down the posts, to provide for a desired vertical spacing between shelf members supported by the beams. This range of vertical adjustability is limited, however, by the post couplers, which serve to interconnect post members in vertical alignment to form a unitary post used as a column.

It will be appreciated that in a shelving apparatus formed by composite posts which are defined by two or more post sections, coupled end-to-end by such couplers, the length of the couplers is typically long enough that the coupler covers at least two levels of rivet-receiving keyhole slots in each of two adjacent post members. The prior couplers then cover, mask or obstruct four levels of slots in the assembled post. This prevents location of shelf-supporting brackets at the vertical height where the post members are joined by the couplers, since no beam supporting rivets can be extended through slots of the post at the ends of the vertical post members and which are covered by the couplers. There is thus a vertically-oriented void area in a prior shelving unit defined by the vertical extent of the useful, but slot-blocking, post couplers.

In addition, it is desirable to enhance or facilitate the combination of a post coupler with a post so that obstruction from linear or flat edges of the components is eliminated.

Accordingly, it is desirable to provide a shelving unit with an unlimited vertical spacing capacity for the shelves where the corner posts are each defined by at least two end-to-end post members.

A further objective of the invention has been to provide a post coupler in combination with corner post members in a shelving unit wherein the couplers may be integrated with the shelf-supporting beams to provide unlimited vertical positioning of the shelf along the length of the shelving unit corner posts.

A further objective of the invention has been to provide a post coupler for accommodating the horizontal shelf supporting beams at their interface with shelf unit corner posts.

A further objective has been to facilitate the combination of a post coupler to a post section.

SUMMARY OF THE INVENTION

To these ends, a preferred embodiment of the invention contemplates a shelving unit having corner posts, each comprising at least two corner post members coupled end-to-end with a post coupler and a plurality of shelf-supporting beams coupled to the corner posts via fasteners, the post coupler having apertures aligned with fastener-accepting apertures in the respective corner post members for receiving such fasteners, wherein the beams can be connected along the corner posts at selected positions, including positions traversed by the post couplers of the corner posts. Apertures in the post coupler are indexed or aligned with apertures in adjacent corner post members so the aperture spacing in the couplers is cooperative with the spacing of apertures in the connected-together corner post members.

Moreover, in a preferred coupler embodiment, the coupler has two main flanges and two inwardly directed, reverse bend flanges for disposition around edges of the post sections from the outside. These reverse bend flanges are of such limited width that they do not extend across any portions of the apertures in either the coupler or the post section. In this way, such couplers provide for unobstructed pass-through of the rivets extending from the beams into and through the couplers and the posts.

In one embodiment of a shelving unit provided with such coupler, a beam is disposed to interface with a post or coupling on the interior side thereof. In another embodiment, the beam is disposed on one exterior side of the coupling post.

These and other features and advantages of the invention will be further readily understood from the following written description and from the drawings in which:

BRIEF DESCRIPTION OF THE DRAWINGS

FIG. 9 is an isometric view similar to FIG. 2 but showing an alternate embodiment with beams mounted on the outside of the coupler;

FIG. 10 is a plan top view taken along lines 10-10 of FIG. 9;

FIG. 11 is a cross-sectional view similar to FIG. 4 but is taken along lines 11-11 of FIG. 9;

FIG. 12 is an elevational view in partial cross-section taken along lines 12-12 of FIG. 10;

FIG. 13 is an enlarged view of the encircled area 13 of FIG. 12;

FIG. 14 is a cross-sectional view taken along lines 14-14 of FIG. 10; and FIG. 15 is an enlarged view of the encircled area 15 of FIG. 14.

DETAILED DESCRIPTION OF THE INVENTION

Figure 1:
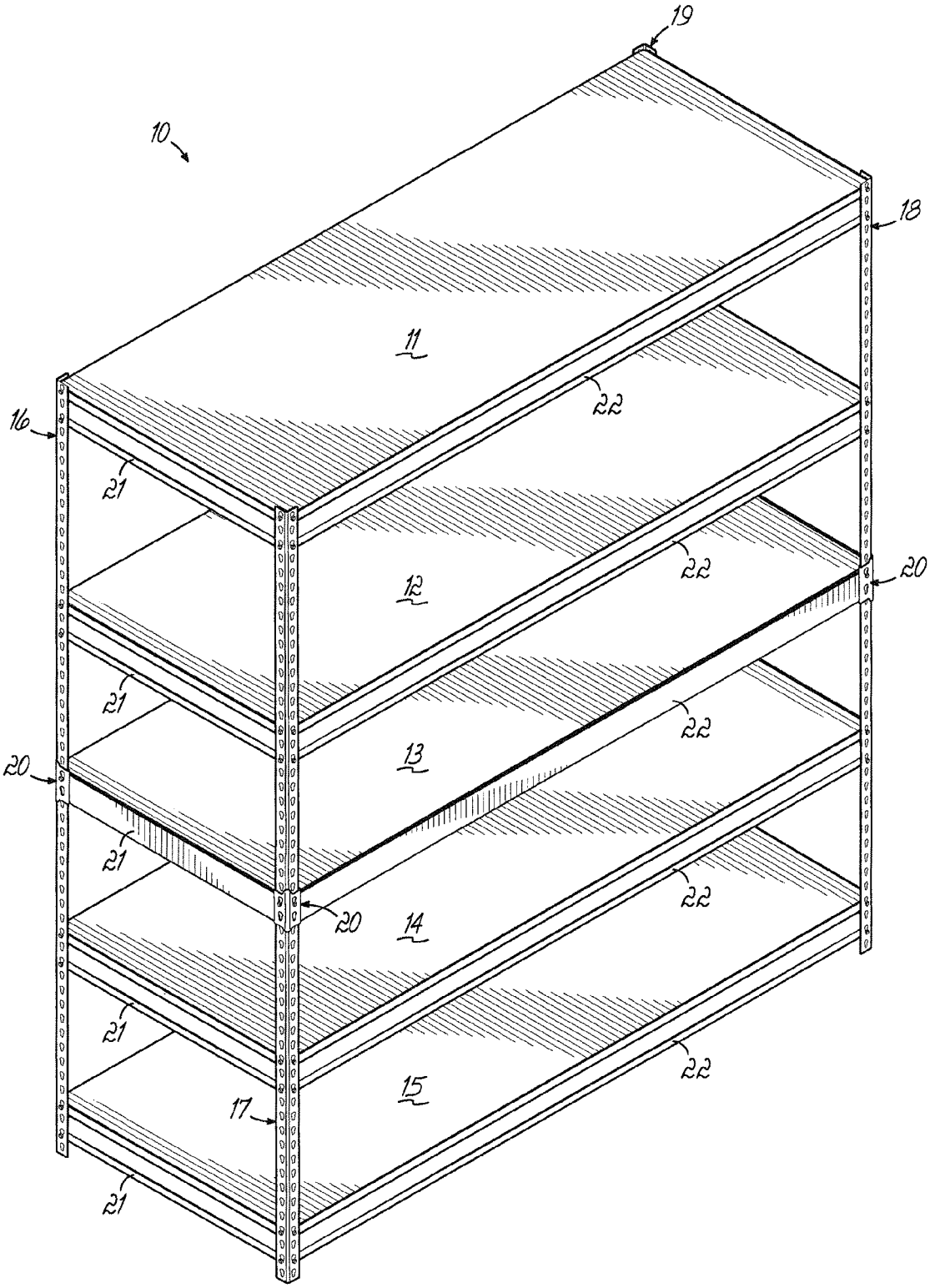
FIG. 1 is an isometric view of a shelving unit according to the invention.

Turning now to the drawings and in particular, to FIGS. 1-8, one embodiment of the invention comprises a shelf unit 10 having a plurality of shelves 11-15. Four composite corner posts or columns 16-19 define the corners of unit 10, each comprising at least two post sections (could be more) joined by a coupler as at 20 (three appear in FIG. 1 for posts 16, 17 and 18, respectively). Each shelf 11-15 is supported by four horizontally-oriented shelf-supporting brackets or beams as at side beams 21, and front and rear beams 22, with front and rear beams 22 being longer than side beams 21. The rear beam and offside beams not shown in FIG. 1 are respectively identical to the front (22) and side (21) beams as shown in FIG. 1. Side beams 21 on one hand and the front/rear beams 22 on the other hand differ essentially only in length and are otherwise identical.

Figure 2:
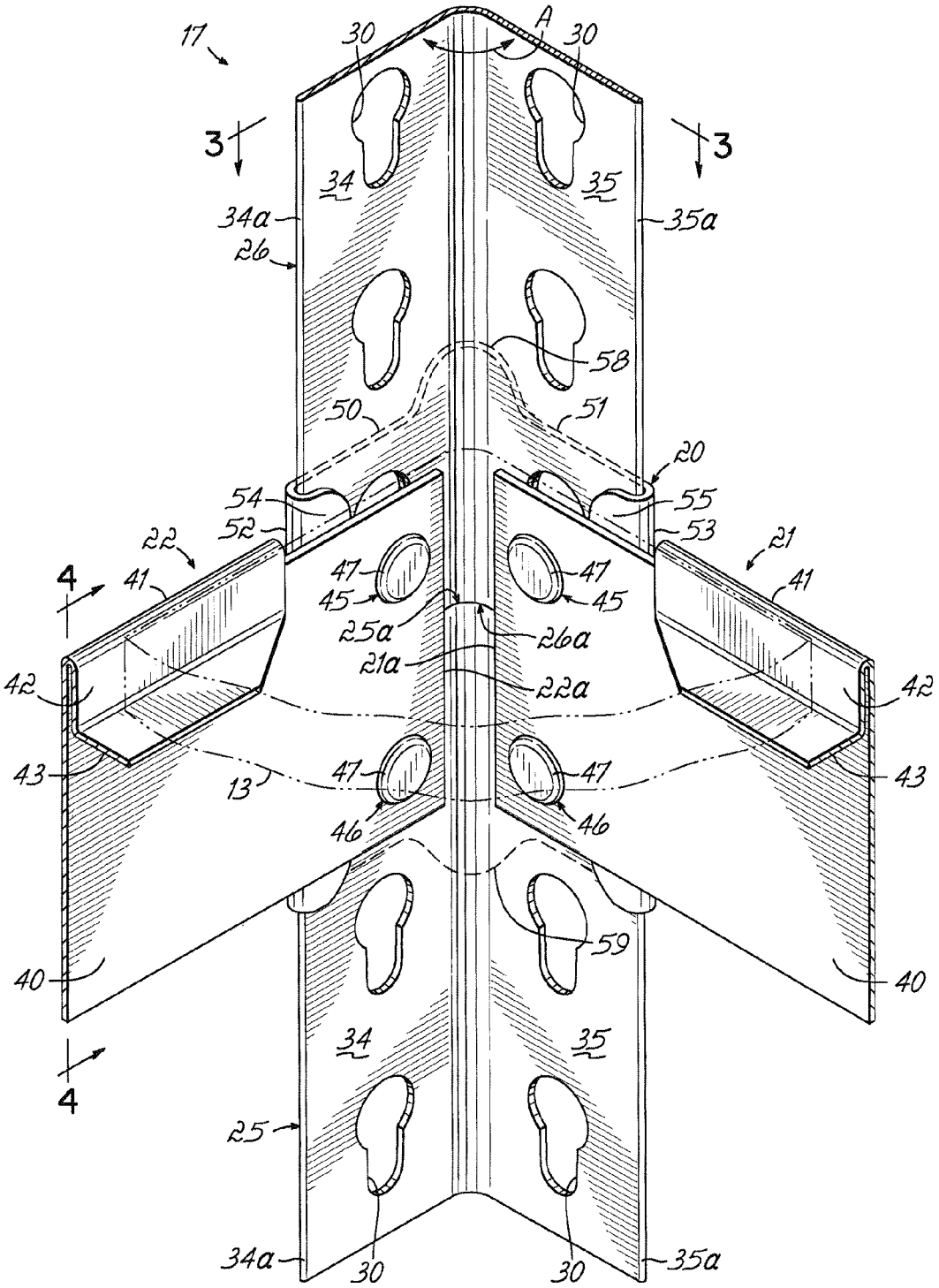
FIG. 2 is an enlarged isometric view of a portion 2 of FIG. 1 from the interior area of the shelving unit and at the juncture of beam, post and coupler.
Figure 2A:
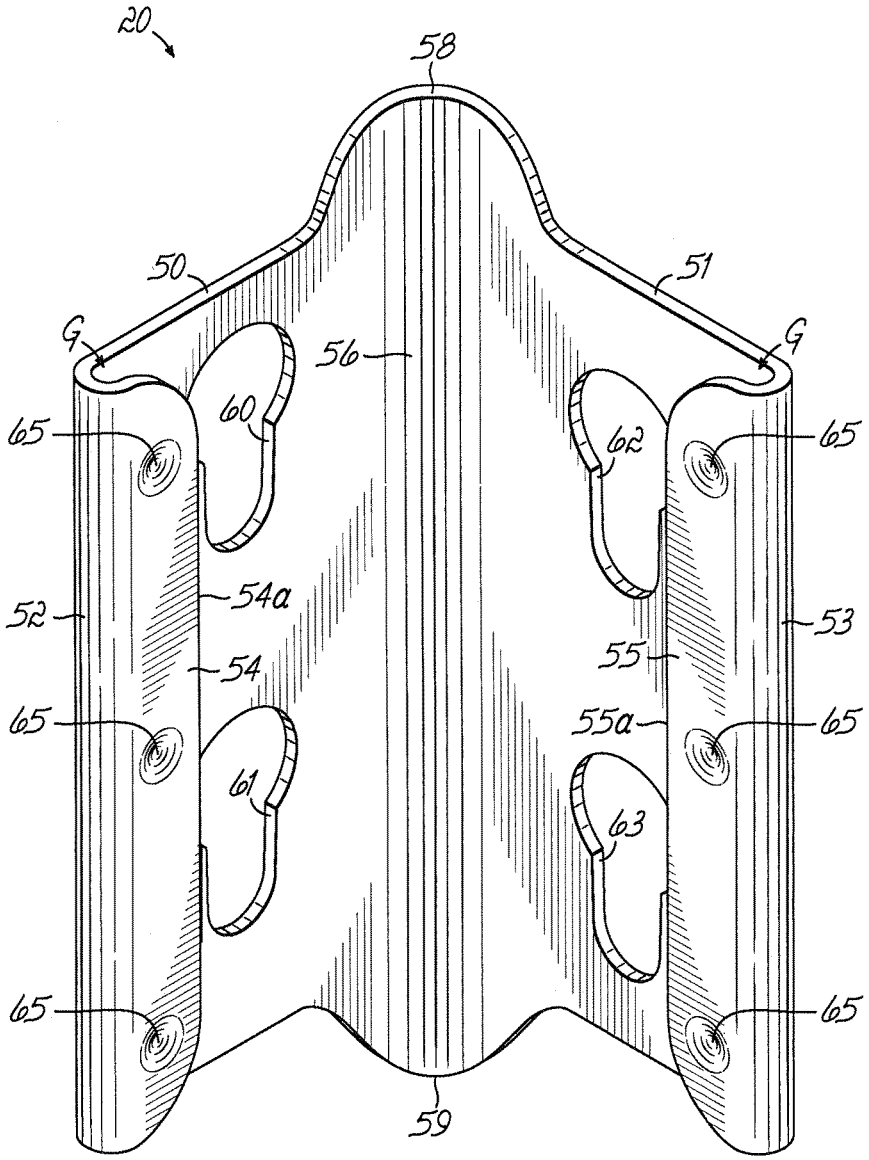
FIG. 2A is an isometric view of the post coupler of the invention.

With attention to FIG. 2, there is shown from the perspective of the interior of the unit 10 a representative corner structure as at post 17, comprised of lower post section 25 and upper post section 26, coupled in end-to-end abutting relationship via coupling or coupler 20 to form a unitary post. The posts, post sections, coupling 20, and the end structure of the beams at each corner of unit 10 are essentially identical, so only one corner structure, coupler, post section and beam intersection as in FIG. 2 will be described.

Figure 3:
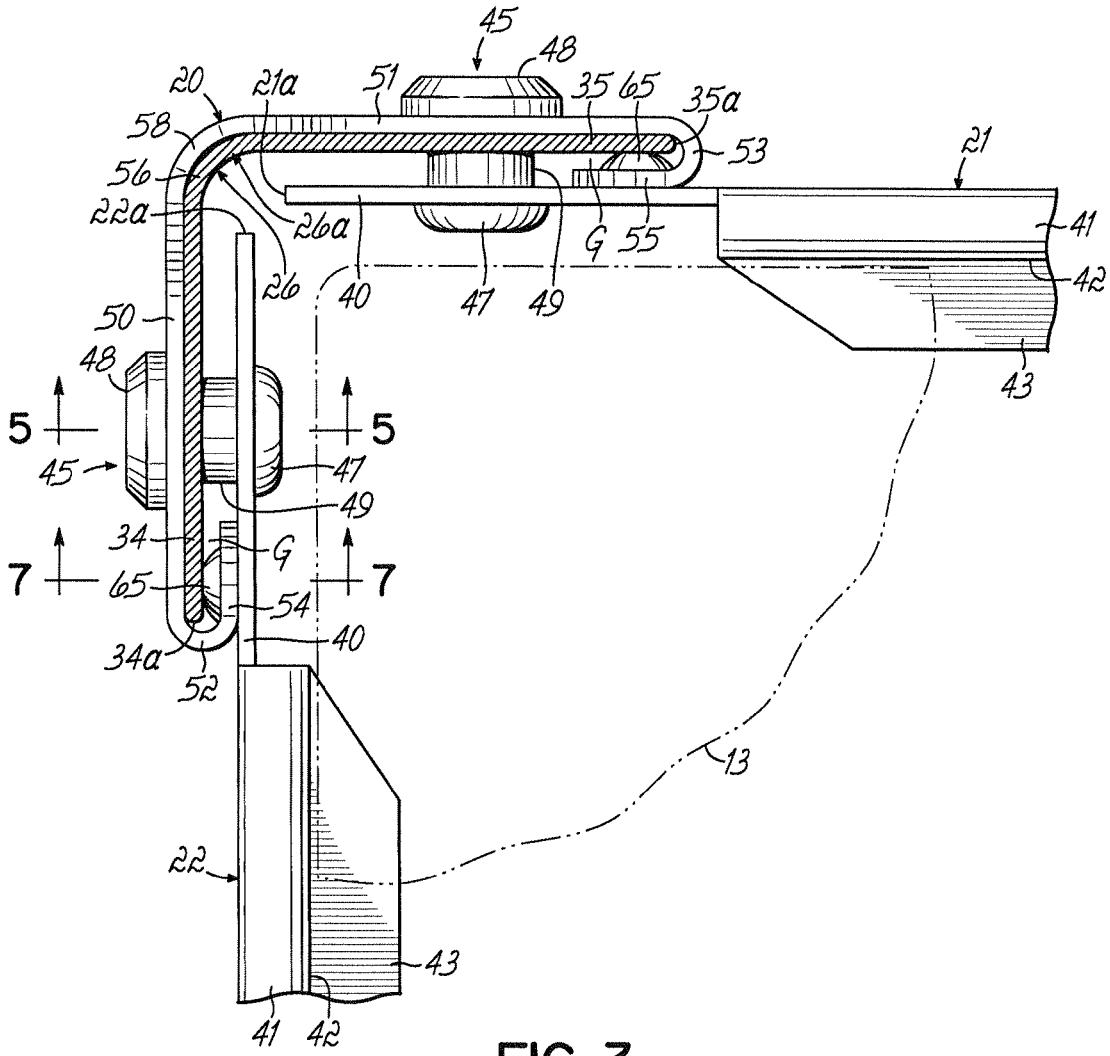
FIG. 3 is a plan view in partial cross-section taken along lines 3-3 of FIG. 2 with an offside portion of the coupler broken away with the beams mounted inside the post and the coupler.
Figure 4:
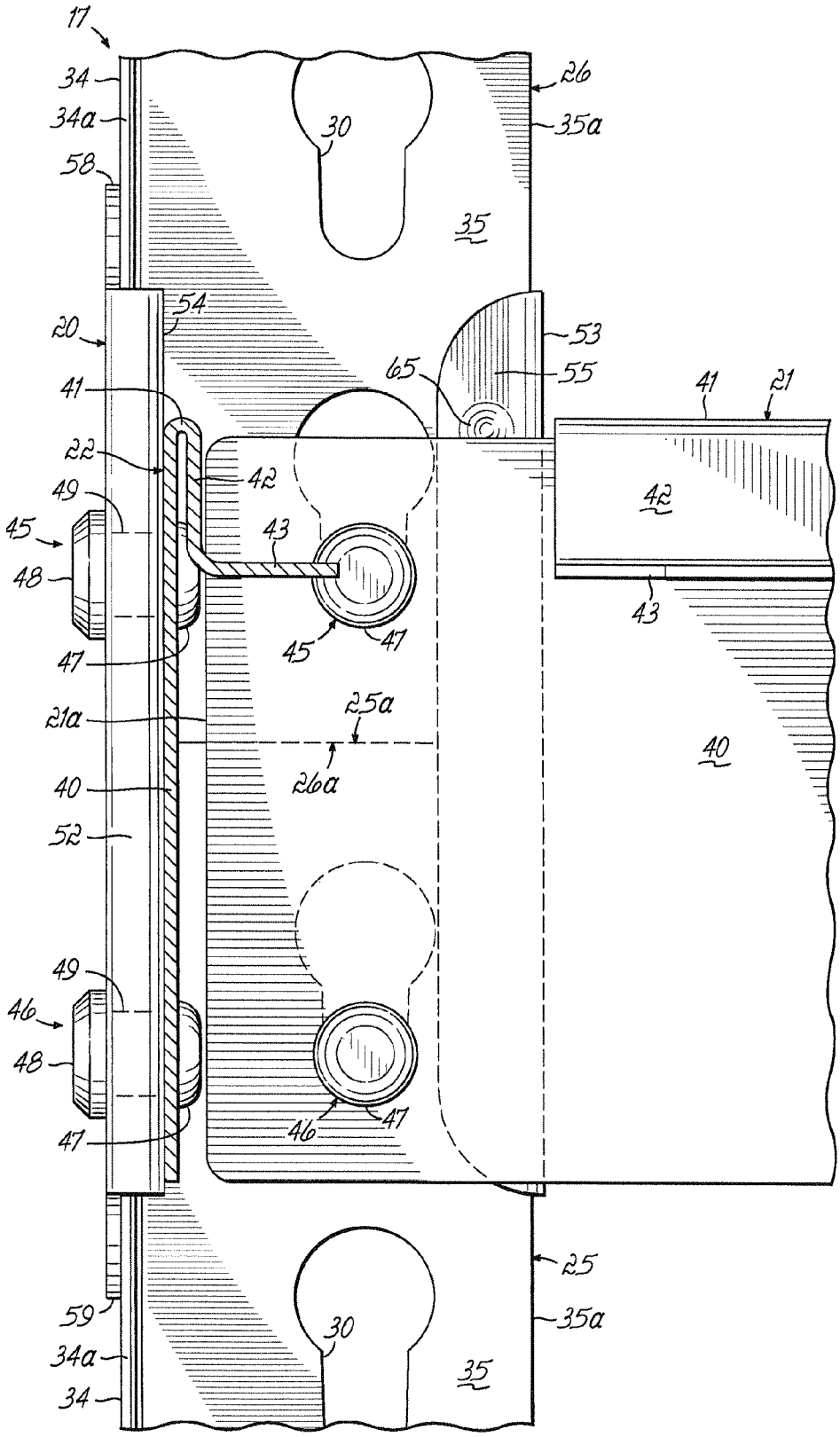
FIG. 4 is an elevational view in partial cross-section of the coupler, posts and beams taken along lines 4-4 of FIG. 2.

For clarity, a shelf such as shelf 13 is shown in phantom lines only in FIGS. 2 and 3.

For purposes of this application, the terms "inner", "inside", or "interior" refer to a post or coupler as viewed from within a shelving unit, while the terms "outer", "outside" or "exterior" refer to the post or coupler as viewed from without a shelving unit.

Each lower and upper post section 25, 26 is provided with a series of keyhole-shaped apertures 30 as shown, each preferably identically spaced in each post section, one from the other. Preferably, the endmost aperture 30 in each post section 25, 26 is spaced from the section ends at one-half pitch so that when sections 25, 26 are abutted, the two endmost apertures 30 are spaced from each other at the same pitch as each aperture 30 is spaced from other apertures 30 in the same post section. Apertures 30 have enlarged and narrower portions as shown.

Each post section 25, 26 is preferably in the form of an angle, formed by two post flanges 34, 35 at a preferred included angle A of about 90° with respect to each other. Each post flange has an elongated edge 34*a*, 35*a* as shown.

Post sections 25, 26 preferably abut each other end-to-end at section ends 25*a*, 26*a*.

As noted, beams 21, 22 are generally identical except for length in this embodiment; the length of such beams being variable to accommodate the width and depth of a desired shelving unit 10. Beams 21, 22 each incorporate a beam web 40, an upper reverse bend at 41, a flange 42 bent to reside alongside an upper margin of web 40, and a 90° bend defining a shelf-supporting flange 43, all as clearly shown in FIGS. 2-5 and 7.

As perhaps best seen in FIG. 3, flanges 42, 43 are terminated short of ends 21*a* and 22*a* of webs 40. Shelf-supporting flanges 43 are relieved or tapered at an angle, as shown in plan view in FIG. 3, in a direction away from ends 21*a*, 22*a*, so as not to interfere with any proximate beam end.

Figure 5:
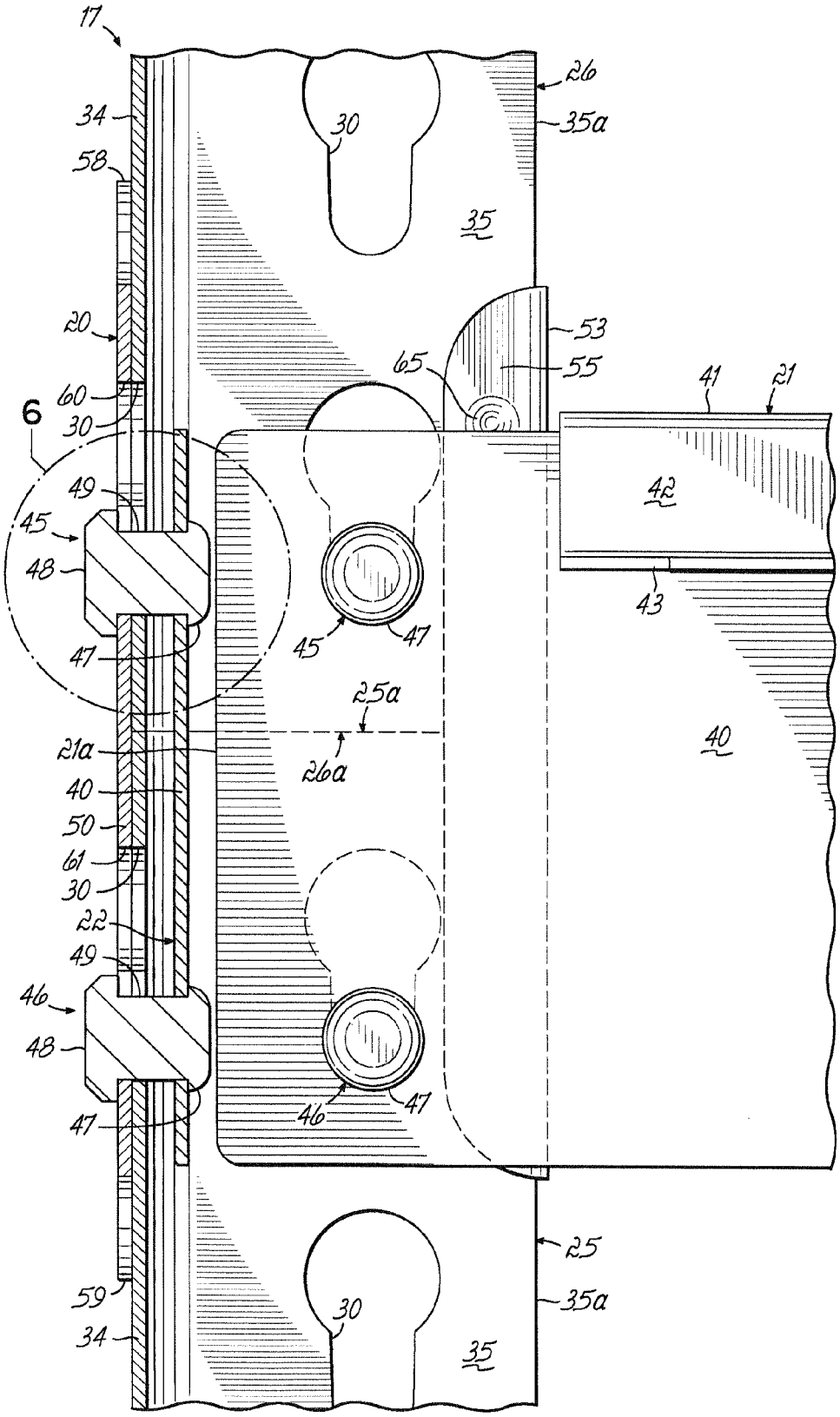
FIG. 5 is a cross-sectional view taken along lines 5-5 of FIG. 3.
Figure 6:
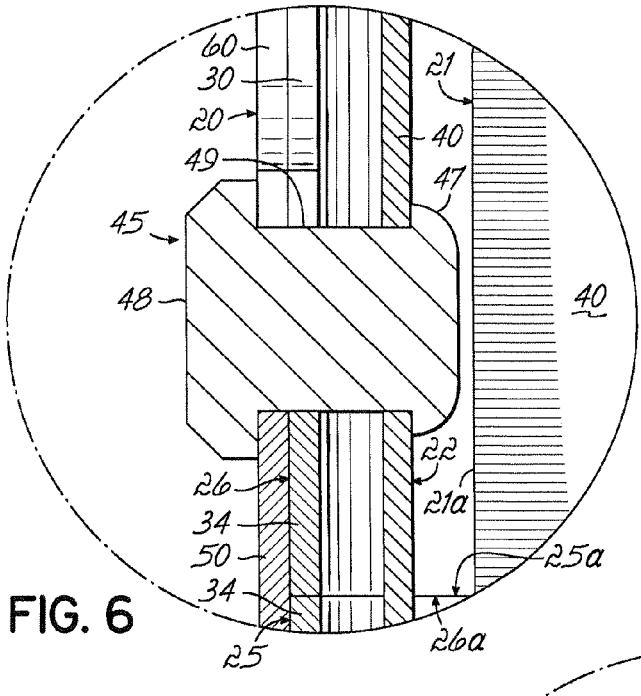
FIG. 6 is an enlarged view of the encircled area 6 of FIG. 5.
Figure 8:
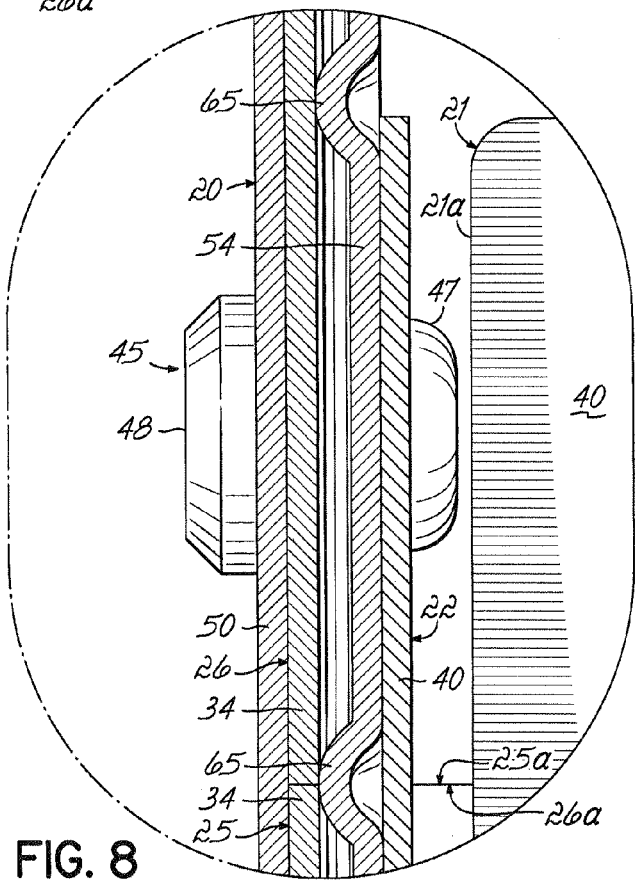
FIG. 8 is an enlarged view of the encircled area 8 of FIG. 7.
Figure 7:
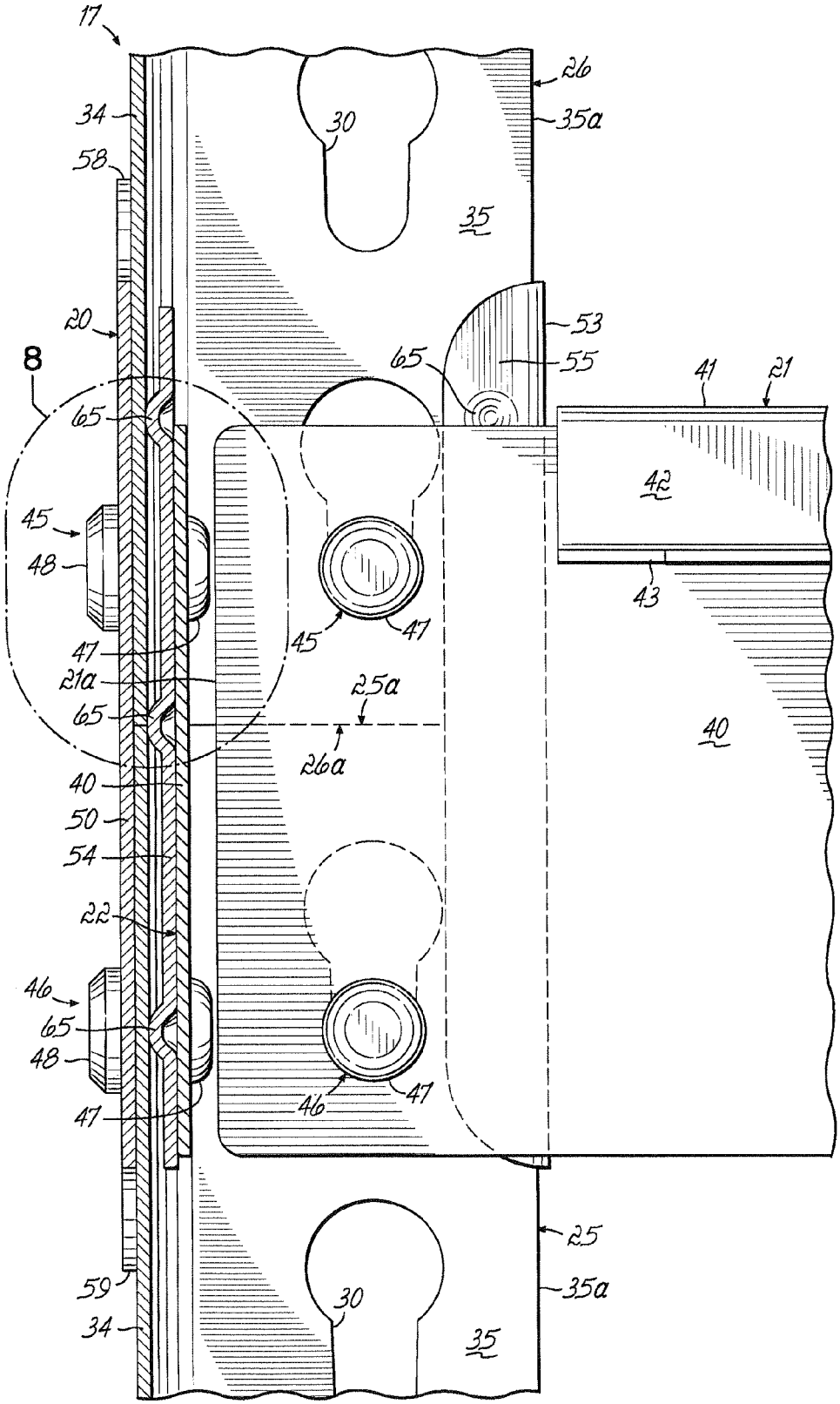
FIG. 7 is a cross-sectional view taken along lines 7-7 of FIG. 3.
Figure 9:
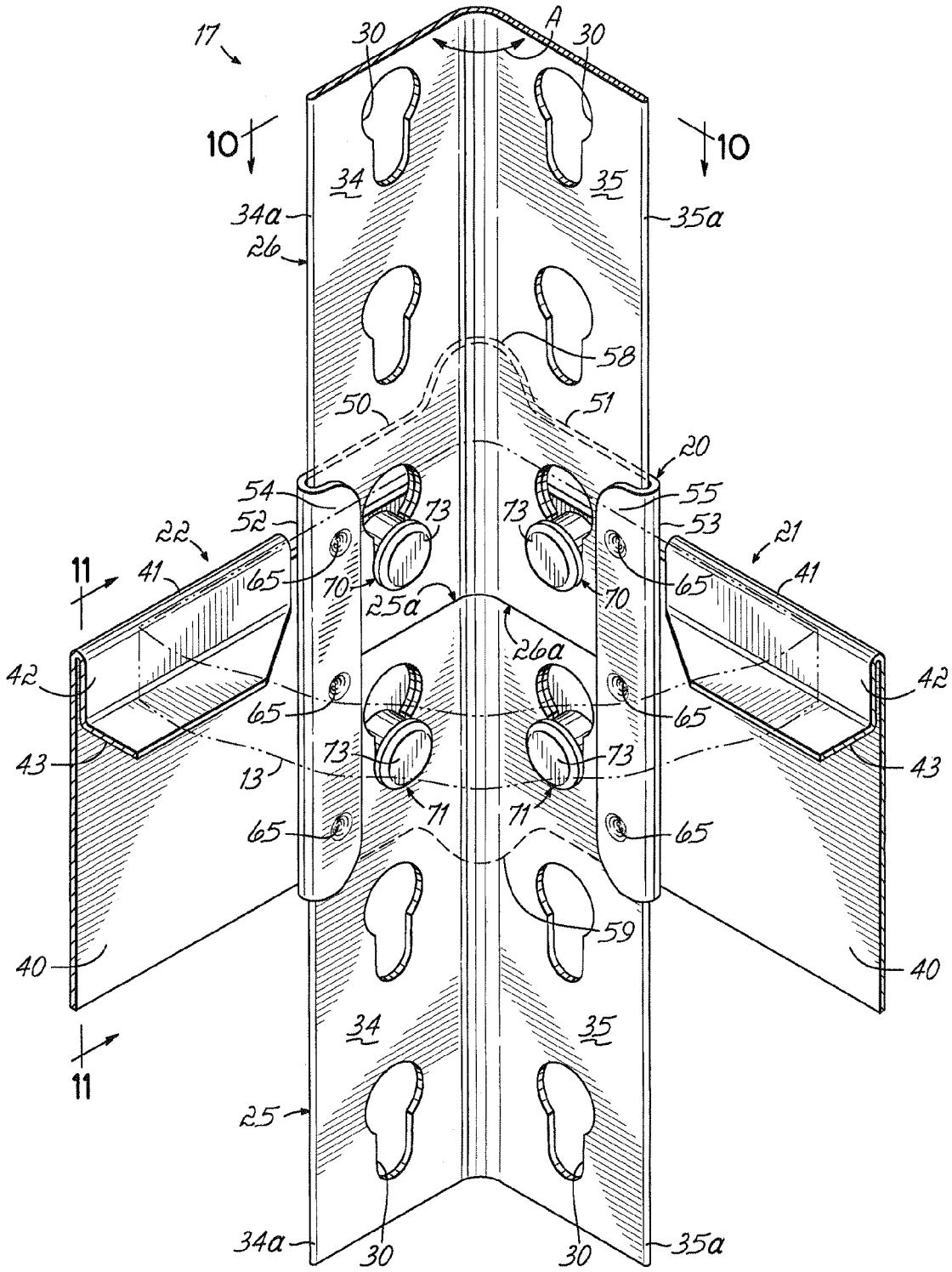
FIGS. 9-15 are similar to FIGS. 2-8 but show an alternate position of the shelf-supporting beams.

Each beam 21, 22 is provided proximate its ends 21*a*, 22*a*, with two beam supporting lugs or rivets 45, 46 (FIG. 4), one above the other. The cross-sectional views of FIGS. 5-6 illustrate one suitable shape of the rivets 45, 46.

Rivets 45, 46 extend through coupling 20 and through respective holes 30 in the post end sections 25*a*, 26*a* described above, and as will be described.

Post coupling 20 is best seen in FIG. 16. The coupling comprises two major integral coupler flanges 50, 51 disposed at an included angle (at bend 56) to each other at preferably 90°, preferably similar to angle A between the post flanges 34, 35.

Each major flange has a reverse bend or fold 52, 53 and an inwardly directed reverse bend flange 54, 55 respectively turned inwardly, each flange 54, 55 lying parallel to the respective flanges 50, 51 from which they extend.

A gap G is defined by the respectively adjacent flanges 50, 54 and 51, 55 respectively, this gap being approximately equal to the thickness of post flanges 34, 35 respectively.

At each end of the bend 56, the coupler 20 includes a rounded projection 58, 59 projecting outwardly from the ends of flanges 50, 51 at bend 56.

Coupler 20 also includes a plurality of keyhole-shaped apertures 60-63 as shown in FIG. 16, one above the other respectively, so apertures 60, 62 are respectively above apertures 61, 63 at the same distance or pitch as separate apertures 30 in the post end sections 25*a*, 26*a*. Apertures 60-63 are preferably in the same shape as apertures 30 in the post sections 25, 26.

Coupler 20 is also provided with a plurality of detents or projections 65 in the respective reverse bend flanges 54, 55. These extend inwardly into the respective gaps G, and serve to frictionally engage post end sections 25*a*, 26*a* in gaps G when the post end sections are inserted into the coupler 20.

In this regard, it will be appreciated the rounded projections 58, 59 serve to aid in the introduction of respective post end sections into the coupler. Thus, projections 58, 59 serve to help guide and facilitate the introduction of the post sections into coupler 20.

Projections 58, 59 extend from coupler flanges 50 and 51 respectively, at opposite ends of the coupler, the distance between their outermost edges defining an overall coupler length. it will be appreciated that the respective reverse bend flanges are shorter longitudinally than said overall length, each terminating short of an end of the coupler defined by the projection.

Finally, note the reverse bend flanges 54, 55 have respective edges 54*a*, 55*a*. These define the inward extent of flanges 54, 55 so the flanges do not extend over and block apertures 60-63. The reverse bend flanges thus do not subtend apertures 60-63, as would block them for passage of rivets as will be discussed.

Turning now to the relationship of the components as coupled and connected in an erected shelving unit, FIGS. 2-8 reflect such a unit where the beams 21, 22 are disposed on the inside of post sections 25, 26 (and posts 16-19). FIGS. 9-15 reflect another embodiment wherein beams 21, 22 reside outside post sections 25, 26 and posts 16-19.

It will be appreciated the concepts shown in FIGS. 9-16 above are identical to those of FIGS. 2-8 and 16, excepting for the relative dispositions, and excepting the length of the respective rivets 45, 46 in FIGS. 2-8 and shorter rivets 75, 76 in FIGS. 9-15.

In FIGS. 2-8, beams 21, 22 are located inside of posts 16-19. Coupler 20 is disposed substantially outside the posts. FIG. 2 broadly illustrates this embodiment while remaining FIGS. 3-8 show its details.

Referring to FIG. 3, coupler 20 is disposed proximate the bottom end 26*a* of upper post section 26, coupler 20 in secure contact with post section 26. Detents 65 frictionally engage and hold post section 26*a* in gap G, it being appreciated there is some flexibility in flanges 54, 55. Webs 40 of beams 21, 22 lie against reverse bend flanges 55, 54 respectively.

Rivets 45 (FIG. 3) and 46 (FIG. 4) extend through webs 40, post section 25, 26 and coupler 20. Interior rivet heads 47 seat on webs 40. Exterior rivet heads 48 are positioned to pass through the enlarged portions of the post section 25 and coupler 20, allowing shanks 49 to seat in the narrower sections of apertures 30, and 60, 62, securing the components together. Exterior rivet heads 48 rest against those portions of post section 26 surrounding the narrow portions of apertures 60, 62.

The same is true of lower rivets 46 respecting apertures 30 in lower post section 25 and coupler apertures 61, 63. It will here be appreciated that since edges 54*a*, 55*a* of coupler 20 do not block apertures 60-63 in coupler 20, and the rivet heads 48 may pass therethrough in the enlarged portions of the apertures to facilitate erection of shelving unit 10.

Turning now to FIGS. 9-15, beams 21, 22 are disposed on the outside of coupler 20 and of posts 16-19 as shown. Components of this embodiment numbered as the same components of FIGS. 2-8 are the same except for relative disposition.

Figure 10:
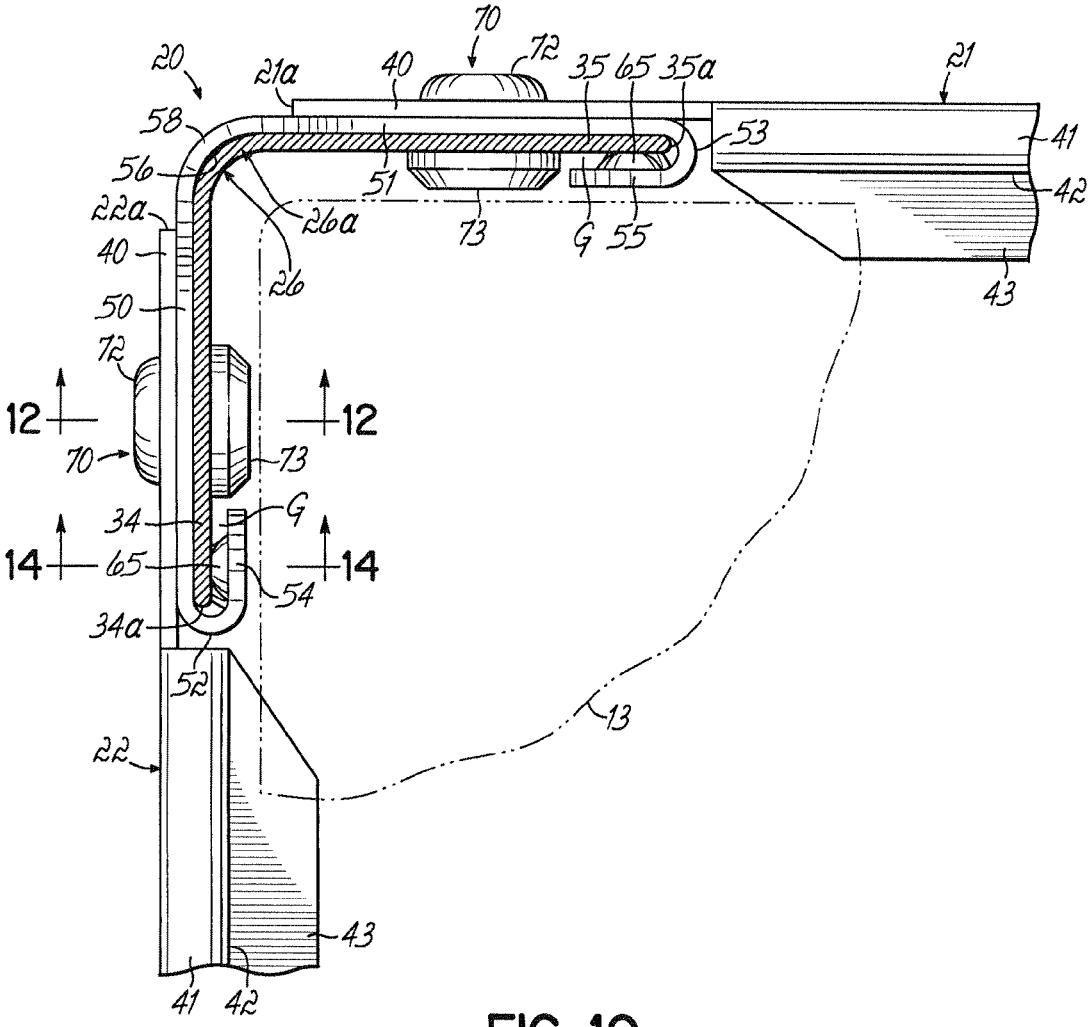
Figure 11:
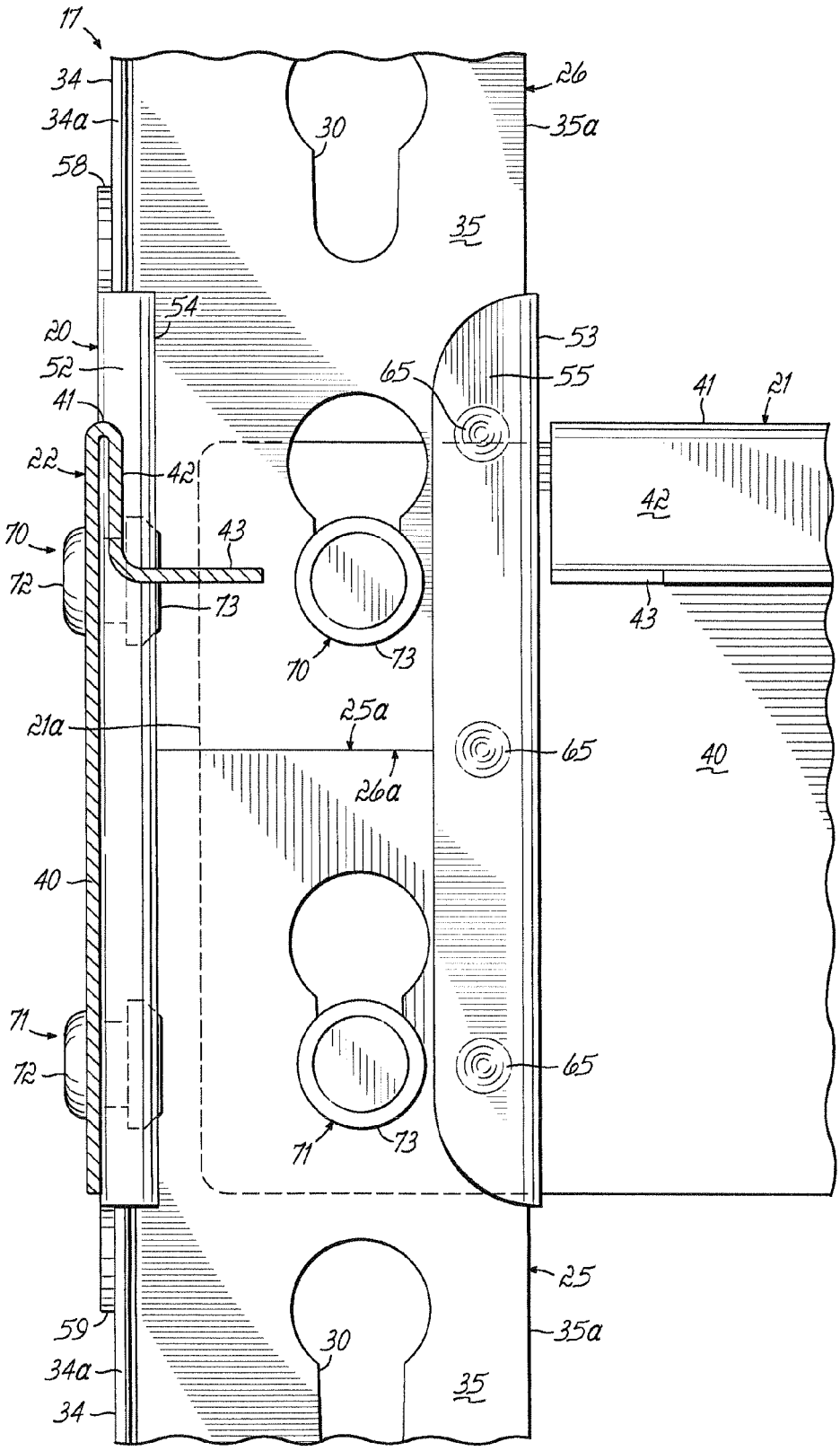
Figure 12:
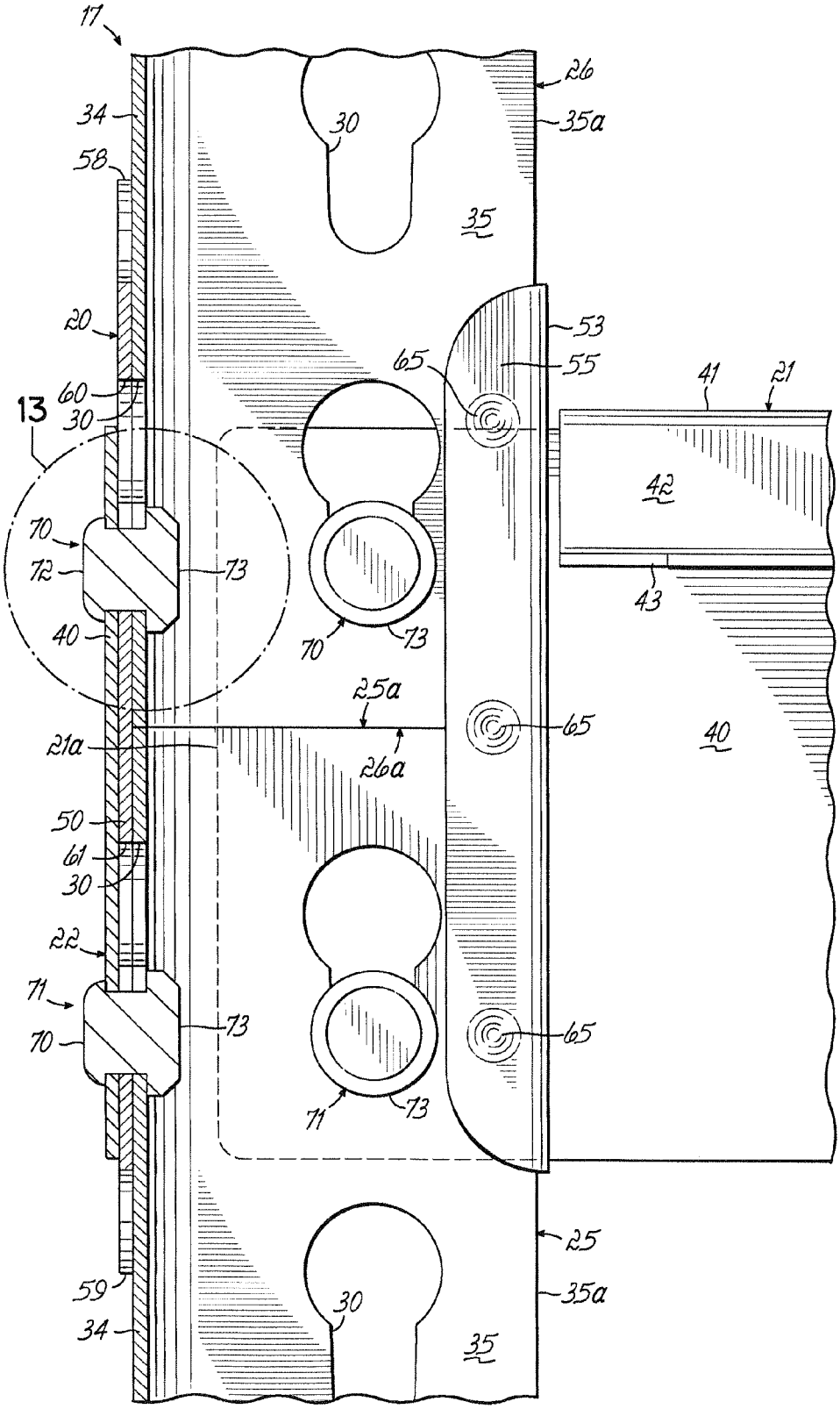
Figure 13:
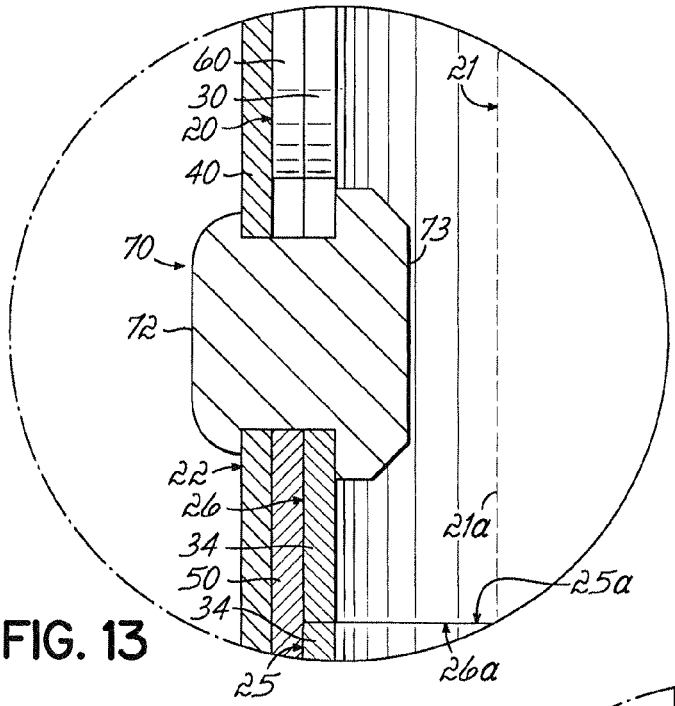
Figure 15:
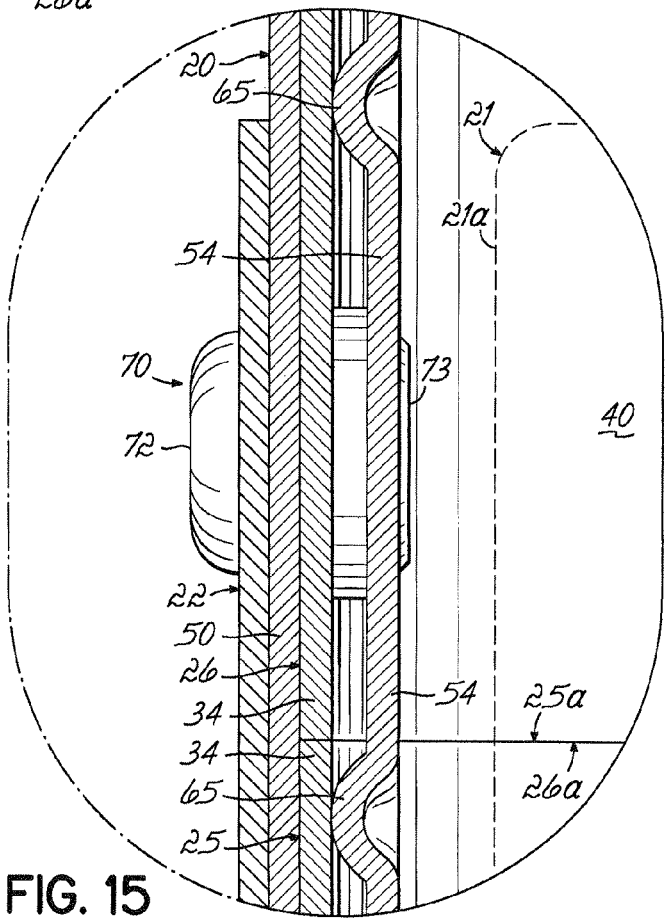
Figure 14:
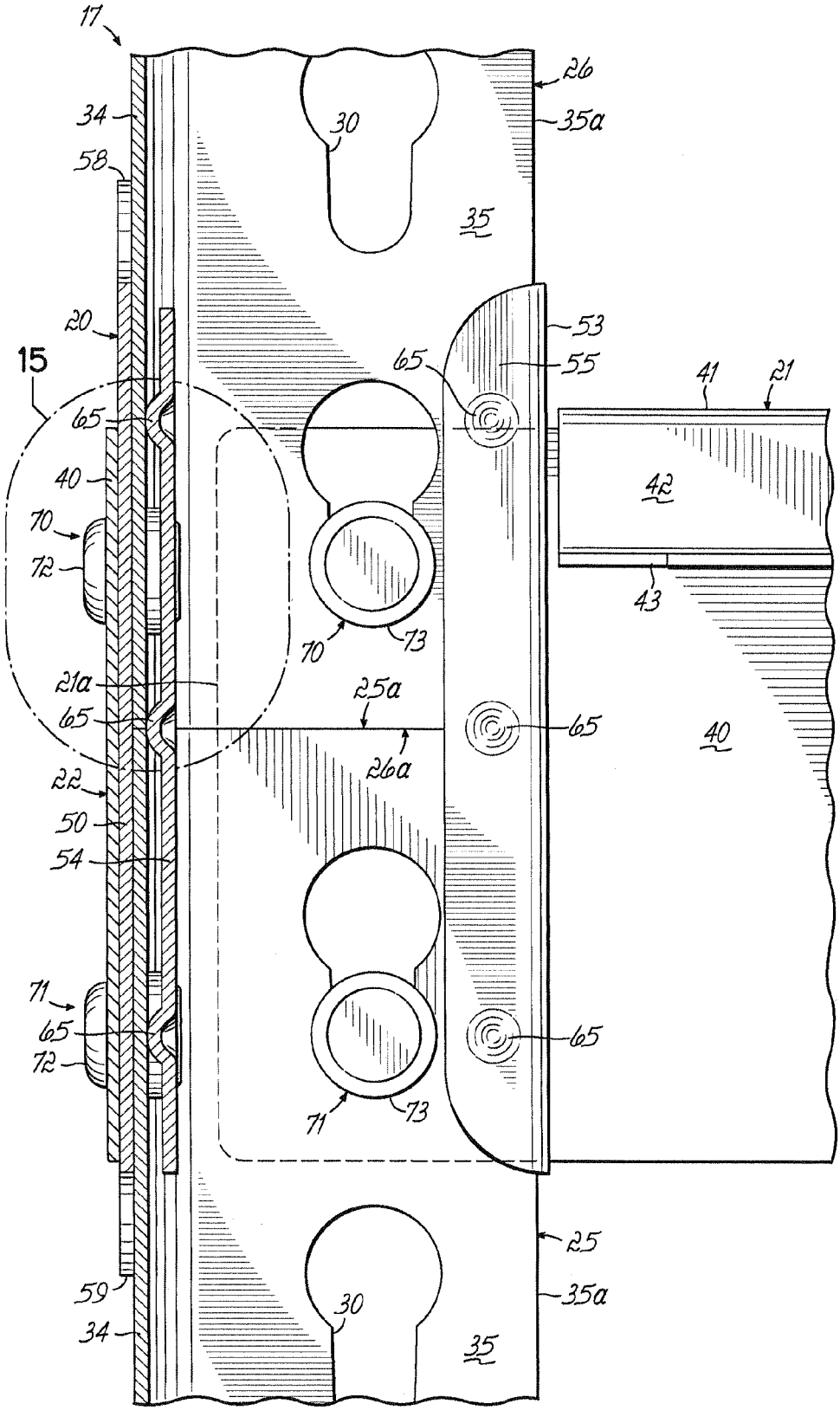

In this embodiment, upper and lower rivets 70, 71 are somewhat shorter than rivets 45, 46 of FIGS. 2-8. Rivets 70, 71 have respective exterior and interior heads 72, 73 (FIG. 10). Interior heads 73 pass through enlarged apertures 60-63 respectively of coupler 20 and post sections 25, 26 respectively, resting on the portions of posts 25, 26 surrounding the narrower portions of apertures 30. Exterior heads engage the webs 40 of the beams 21, 22.

FIGS. 10-15 illustrate in respective cross-section the details of this embodiment. A shelving unit as in this embodiment will have the appearance of unit 10 of FIG. 1, excepting the ends of beams 21, 22 will be positioned outside posts 16-19 and couplers 20.

It will also be appreciated that the invention may include other configurations of the beams 21, 22 suitable with end structures as depicted herein. Other shelf-supporting elements formed in other such beams can be provided to produce shelving units of other configurations, such as where the surfaces of the shelves are disposed below the upper edges of the beams, for example.

Accordingly, this invention contemplates a post coupler in outside wrap form with flanges wrapping around the edges of an angular post from the outside and accommodate shelf-supporting beams disposed at their ends interiorly of the posts or alternately on the outside of the posts, and the couplers accommodating beam supporting rivets without limit to the vertical beam position and shelves supported thereby within the height of the shelf unit corner posts including the areas where composite sections of the post are coupled.

These and other modifications and variations of the invention will be readily appreciated by the foregoing to those of ordinary skill in the art without departing from the scope of the invention and applicant intends to be bound only by the claims appended hereto.

What is claimed is:

1. A post coupler for use in a shelving unit having composite corner posts of two angular post sections comprising post flanges of predetermined thickness and having longitudinally-extending lateral edges, one post section atop another, each section at a respective end abutting with another section and having longitudinally spaced rivet receiving apertures extending through each said post flange, spaced from said lateral edges a first distance, for receiving rivets extending from end potions of horizontal, shelf-supporting beams, said post coupler comprising:

a pair of integrally-formed post coupler flanges with planar interior surfaces connected at a longitudinally-extending interior corner forming an included angle with respect to each other;

an integrally-formed reverse bend flange extending laterally inwardly in a direction toward said interior corner from a longitudinally-extending distal edge of each post coupler flange, each reverse bend flange having a lateral width and a planar interior surface facing a respective said post coupler flange;

each reverse bend flange and each respective post coupler flange forming a gap therebetween as wide as said predetermined thickness for receiving said abutting ends of said post flanges respectively therein; and a plurality of longitudinally spaced apertures extending through each of said post coupler flanges for indexing with apertures in said post sections when said coupler couples said post sections together and said reverse bend flanges having longitudinally-extending distal edges laterally spaced from said apertures in said post coupler flanges for allowing rivets extending from said shelf-supporting beams to extend through aligned said apertures in said post coupler flanges and in said post flanges.

2. A coupler as in claim 1 wherein said coupler includes an upper edge and a lower edge, both said edges comprising a completely rounded projection for facilitating insertion of said abutting ends of said post sections within said gap between said reverse bend flanges and said post coupler flanges.

3. A coupler as in claim 2 wherein each projection extends longitudinally from said post coupler flanges, ends of said projections defining an overall longitudinal length of the coupler.

4. A coupler as in claim 3 wherein said reverse bend flanges have a longitudinal length less than said overall longitudinal length.

5. A shelving unit comprising composite corner posts of two angular post sections comprising post flanges of predetermined thickness and having longitudinally-extending lateral edges, one post section atop another, each section at a respective end abutting with another section and having longitudinally spaced rivet receiving apertures extending through each said post flange, said apertures spaced from said lateral edges a first distance, for receiving rivets extending from end portions of horizontal, shelf-supporting beams, and a post coupler coupling said angular post sections together, said post coupler comprising:

a pair of integrally-formed post coupler flanges with planar interior surfaces connected at a longitudinally-extending interior corner forming an included angle with respect to each other;

an integrally-formed reverse bend flange extending laterally inwardly in a direction toward said interior corner from a longitudinally-extending distal edge of each post coupler flange, each reverse bend flange having a lateral width less than said first distance and a planar interior surface facing a respective said post coupler flange;

each reverse bend flange and each respective post coupler flange forming a gap therebetween as wide as said predetermined thickness and receiving said abutting ends of said post flanges respectively therein;

a plurality of longitudinally spaced apertures extending through each of said post coupler flanges operatively aligned with apertures in said post sections; and said reverse bend flanges having longitudinally-extending distal edges laterally spaced from said apertures in said post coupler flanges for allowing rivets extending from said shelf-supporting beams to extend through aligned said apertures in said post coupler flanges and in said post flanges.

6. A shelving unit as in claim 5 wherein said coupler includes an upper edge and a lower edge, both said edges comprising a completely rounded projection for facilitating insertion of said abutting ends of said post sections within said gap between said reverse bend flanges and said post coupler flanges.

7. A shelving unit as in claim 5 wherein said coupler has a predetermined longitudinal length and wherein said reverse bend flanges have a longitudinal length less than said longitudinal length.

8. A shelving unit as in claim 5 further comprising:

at least one shelf-supporting beam mounted on said corner posts and onto said reverse bend flanges of said post coupler.

9. A shelving unit as in claim 8 further including an elongated rivet member extending from each said beam through a respective said aperture in one of said post flanges and through a respective said aperture in one of said post coupler flanges.

10. A shelving unit as in claim 8 wherein said beam is mounted on and in engagement with a said post coupler flange.

11. A shelving unit as in claim 10 further including an elongated rivet member extending from each said beam through a respective said aperture in a said post coupler flange and a respective said aperture in one of said post flanges.

12. A shelving unit as in claim 5 further comprising:

a plurality of horizontally-oriented shelf-support beams having respective ends mounted on respective corner posts;

said ends mounted against respective flanges of a respective said post coupler on each corner post; and an elongated rivet member extending from an end of each beam through a said aperture in a said post flange and through a said aperture in a said post coupler flange.

* * * * *